US006800050B2

(12) United States Patent
Moavro et al.

(10) Patent No.: US 6,800,050 B2
(45) Date of Patent: Oct. 5, 2004

(54) AIRFLOW AND CONDITIONING CONTROL APPARATUS FOR EXERCISE EQUIPMENT

(76) Inventors: Horacio Ricardo Oscar Moavro, Moldes 4186, "1"- (1429) Capital, Buenos Aires (AR); Jose Maria Texier, Moldes 4186, "1"- (1429) Capital, Buenos Aires (AR)

( * ) Notice: Subject to any disclaimer, the term of this patent is extended or adjusted under 35 U.S.C. 154(b) by 7 days.

(21) Appl. No.: 10/392,145

(22) Filed: Mar. 19, 2003

(65) Prior Publication Data

US 2003/0181289 A1 Sep. 25, 2003

(51) Int. Cl.[7] ..... A63B 21/00
(52) U.S. Cl. ..... 482/8; 482/1; 482/900
(58) Field of Search ..... 482/1–9, 51, 54, 482/57, 900–902

(56) References Cited

U.S. PATENT DOCUMENTS 5,102,380 A * 4/1992 Jacobson et al. ..... 482/54
5,129,450 A * 7/1992 Hung ..... 165/168
6,300,694 B1 * 10/2001 Wang et al. ..... 310/62

* cited by examiner

*Primary Examiner*—Glenn E. Richman
(74) *Attorney, Agent, or Firm*—William B. Ritchie

(57) ABSTRACT

An apparatus having a data processing unit, a plurality of inputs, a plurality of outputs, a keyboard, a screen, a reading and saving unit, a saving unit, an indicator, a plurality of sensors and a plurality of controllers. The data processing unit provides a program that can be combined with the data sent by at least one sensor capturing the intensity of use of the equipment through an input and selects and derives to an output, one of a plurality of variables of response of at least one air flow and conditioning controller. The program also combines modifications of the responses of the controllers optionally entered from an input linked to the keyboard or from an input linked to a reading and saving unit and derives the resulting data to an output linked to a screen. Some sensors linked to corresponding inputs provide indications of the user's physical conditions comparable to the date previously saved which, through corresponding outputs circumstantially lead to a warning to the screen and the indicator. The physical data captured by the sensors are optionally derived by the data processing unit to an output linked to a storage unit.

6 Claims, 1 Drawing Sheet

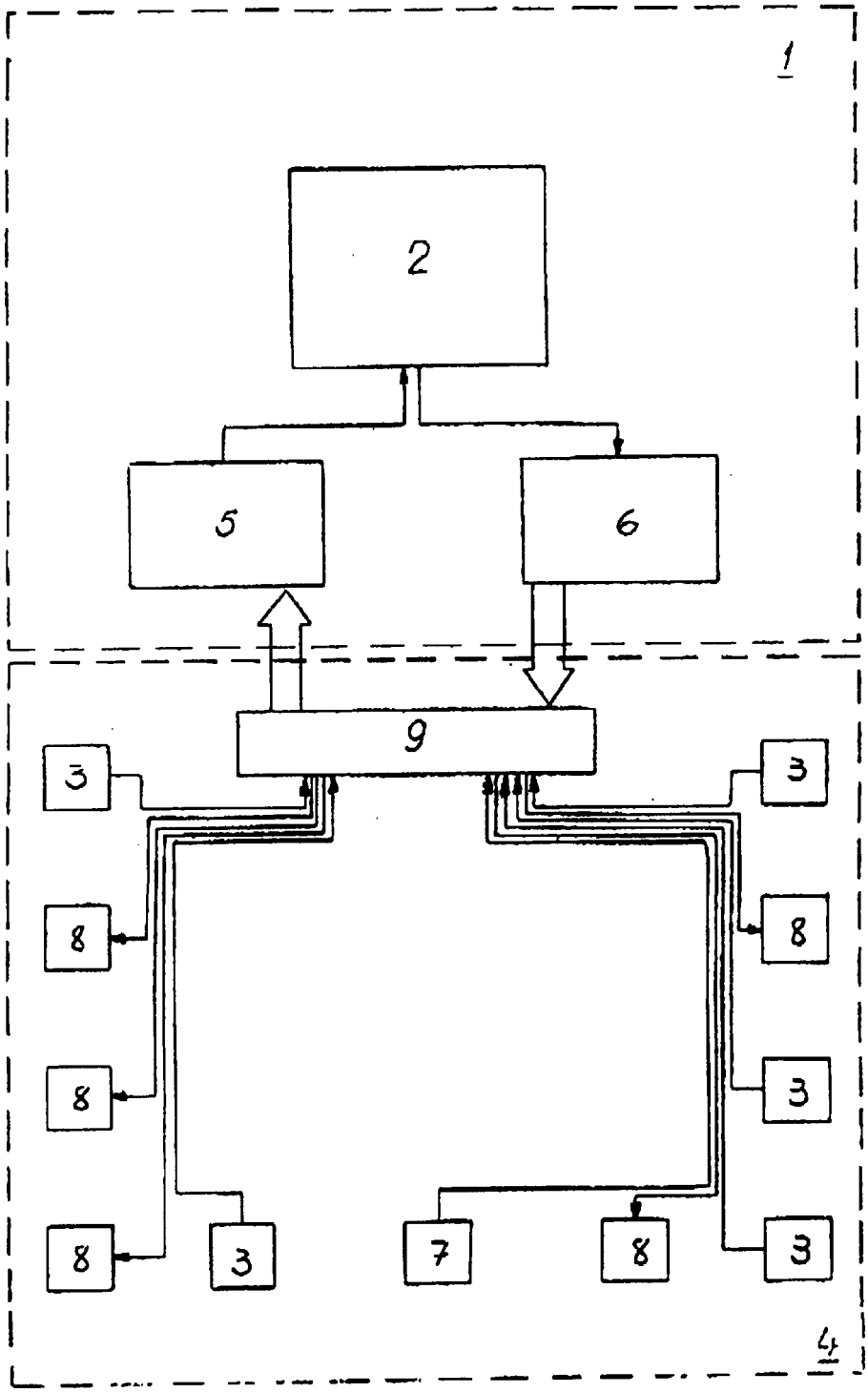
1
2
5
6
9
3
3
8
8
8
3
8
3
7
8
3
4

AIRFLOW AND CONDITIONING CONTROL APPARATUS FOR EXERCISE EQUIPMENT

FIELD OF THE INVENTION

The invention relates to an air flow and conditioning control arrangement for treadmills and similar equipment.

BACKGROUND AND SUMMARY OF THE INVENTION

The inventors have taken into account the needs, as well as various practical and economic aspects which have led them to make this embodiment.

First, they have considered that training or exercise indoors is increasingly frequent. This has been partially supported by a greater general awareness of the benefits of exercise, a proliferation of gymnasiums and clubs equipped for that purpose and complimentarily by the lack of time to go outdoors.

When going to such exercise centers, the user is in a place where multiple elements designed to shape different muscular groups are arranged.

The place normally has some kind of air conditioning equipment, whether to modify the temperature as in the case of air conditioners themselves or to move air, as in the case of ventilators.

The problem is that when exercising with the different machines, users suffer a rise in body temperature. Where, in the same location, we have people whose temperature is rising due to exercise, we also have others whose temperature is lowering because they are between two series of routines. We also have a third group whose bodies show a stable temperature, which can be high in the case of those who are doing exercise or low for those who have not started yet.

Thus, the users are in an environment with a uniform temperature caused by the air conditioning or moving equipment and having a group of people whose bodies have different needs.

Under these conditions, unifying ambient temperature is not appropriate for all the people present according to the cases mentioned above. This is the reason for which the inventors have considered the possibility of incorporating an air flow and conditioning control arrangement that can be adjusted to each piece of equipment used in these centers.

Fundamentally, the inventor has considered that such arrangements must be integrated to the treadmill used to simulate walks and races, taking into account that the body thermo-regulating mechanism cannot have airspeed in its favor in order to lower the temperature.

In effect, in outdoor walks and races, the runner's body runs against the air mass receiving a breeze that is directly proportional to the speed reached. A fact that obviously does not occur on a treadmill, because the runner is still in relation to the surrounding air mass and it is the belt that moves.

Although it is true that there are other factors that influence the runner's temperature, such as rain, outside temperature, humidity, sun radiation, wind, proximity to forests, large bodies of water, as well as individual physical features. The inventors have considered that it is possible and easy to relate the runner's displacement speed to airspeed, thereby aiding to lower the body temperature by copying a natural way to do so.

Therefore one aspect of the present invention is to obtain an air flow and conditioning control arrangement for treadmills and similar equipment that links the speed of the air flow to the speed of the belt displacement or to the equipment operation frequency.

Another aspect of the present invention is that the arrangement disclosed allows the user to modify the speed of the air flow according to the preferences of the user of the treadmill or similar equipment.

Another object of the present invention is that the arrangement disclosed allows the user to modify the temperature and humidity of the air flow according to a selection made by the user.

These and other aspects of the invention will become apparent in light of the detailed description of the invention which follows.

BRIEF DESCRIPTION OF THE DRAWINGS

FIG. 1 is a block diagram of the arrangement disclosed herein is drawn.

DESCRIPTION OF THE PREFERRED EMBODIMENTS

In the FIGURE described, the same reference numerals denote equal or corresponding parts, reserving reference numeral 1 denotes a data processing unit; reference numeral 2 for an input; reference numeral 3 for a sensor and reference numeral 4 for a treadmill or similar equipment. Reference numeral 5 is reserved for a keyboard; reference numeral 6 for a controller; reference numeral 7 for a screen and reference numeral 8 to denote an output. Reference numeral 9 is reserved for a saving unit; reference numeral 10 for a reading and storage unit and reference numeral 11 for an indicator. Letter "a" shows the air flow direction.

This invention is an air flow and conditioning control arrangement for treadmills and similar equipment comprising a data processing unit that includes a program suitable for a function to be performed; a plurality of inputs and outputs that link the processing unit to a keyboard, a screen, at least one sensor and a plurality of peripherals.

Operation

Having established the components of the invention disclosed herein, it will now be complemented with the operative relation between them and the results that are obtained.

In order to obtain an air flow and conditioning control arrangement for treadmills and similar equipment, a data processing unit 1, which is the type of microprocessors provided with a program, is provided.

The data processing unit 1 receives via input 2 the data provided from at least one sensor 3 located on treadmill 4 or similar equipment.

The data processing unit 1 is linked through another input 2 to a keyboard 5 from which data can be entered to modify certain parameters and with it the responses of the program.

The keyboard 5 allows a user to adjust the response of the air flow and conditioning controllers 6 by adjusting them to each individual's conditions or to the conditions required by the user at a certain time.

The changes made by the keyboard 5 are displayed on a screen 7, preferably a liquid crystal type so that the user can make corrections prior to entry to the program.

Such changes are preferably not entered into the memory residing in the data processing unit 1 so that when it is set off they are erased thus avoiding the alteration of pre-saved programs.

Having entered the changes and started to use the treadmill 4 or similar equipment, the screen 7 will display the values captured by the sensor(s) 3 as well as the values that correspond to the programmed response so that the user or another person can check the training conditions.

In the case of the adjustment of the invention when applied to a treadmill 4, the sensors 3 capture the speed thereof as a function of the walk or running speed of treadmill 4 as selected by the user.

The value captured is sent from the corresponding sensor 3 to an input 2 and from the latter to the data processing unit 1.

The program incorporated into the data processing unit 1 exhibits a plurality of variants one of which will have been previously selected or changed.

The selection determines that the user of the treadmill 4 receives from at least one controller 6, an air flow A that will have a speed equivalent to that which the user's body would receive if he moves in the open air which results in an apparent wind.

The air flow speed A received by the user may be increased in a predetermined factor which is equivalent to the displacement produced by the wind.

The factor can be varied by entering an algorithm to produce the increased sensation and the reduction of the intensity of the air flow A produced outdoors, or it can be kept constant if this is preferred by the user.

The controllers 6 can therefore include rotors with blades to produce the displacement of air flow A in the direction of the user from one or more points so as to represent a crosswind, head wind or following wind. This can be made by combining it with the displacement of the air flow A the user would receive due to his motion.

The arrangement disclosed herein can combine controllers 6 that produce the displacement of the air flow A as those mentioned above, with others that modify the temperature and humidity of the air surrounding the user in order to create the conditions that the user would find in various environments.

Therefore, by entering the necessary data through the keyboard 5, the user can modify the program and with it the response of the controllers 6 in order to train in an environment that reproduces the conditions he will encounter during competition.

The program of the data processing unit 1 can incorporate a selection of responses of the controllers 6 that represent the ambient conditions of different locations so that the user may select the choice he wishes or needs so that, through the output 8, linking the data processing unit 1 to the controller (s) 6, the program reproduces the response sought.

The sensors 3 may be located in any equipment of the type of those located in gyms, health clubs or similar facility so that each user can adjust the ambient conditions in which he will train as he wishes or is convenient to him.

The treadmill 4 or similar equipment can incorporate sensors 3 in order to make the physical controls the data of which can be derived to a saving unit 9 that will allow the user to take them with him to consult a reliable physician about the convenience of modifying certain parameters.

In turn, such sensors send the data captured to the program residing in the data processing unit 1 which compares them to pre-saved data and, if considered risky to the user, sending a warning to him through indications on the screen 7.

In the preferred embodiment each user may store his recreational environment as well as his working physical conditions which can be taken with him so that he can enter that information from storage unit 10, linked to the data processing unit 1. In this way, each user can personalize the treadmill 4 or similar equipment, according to his preferences and physical condition without needing to use the keyboard 5 every time the invention is used. In the preferred embodiment, the data processing unit 1 provides an indicator 11 that sends an alarm signal to a general control point. The alarm signal coincides with the warning given to the user through the screen 7 and is based on the data previously saved by the user or on general parameters in the case of treadmills and similar equipment that have not been personalized.

In a simplified embodiment, the controllers 6 are commanded by regulating the intensity of the air flow A in a direct relation with the intensity of use of the treadmill 4 or similar equipment.

While certain representative embodiments of the invention have been described herein for the purposes of illustration, it will be apparent to those skilled in the art that modification therein may be made without departure from the spirit and scope of the invention.

What is claimed is:

1. An air flow and conditioning control apparatus for exercise equipment comprising a data processing unit, a plurality of inputs, a plurality of outputs, a keyboard, a screen, a reading and saving unit, a saving unit, an indicator, a plurality of sensors and a plurality of controllers; wherein said data processing unit provides a program that can be combined with the data sent by at least one sensor capturing the intensity of use of the equipment linked to an input and selects one of a plurality of variables of response of at least one air flow and conditioning controller linked to an output; said program combines modifications of the responses of the controllers optionally entered from the keyboard or from the reading and saving unit linked to corresponding inputs and derives the resulting data to a screen linked to an output; wherein some sensors linked to inputs provide indications of the user's physical conditions comparable to the data previously saved in the program of said data processing unit which circumstantially derives a warning to the screen and to the indicator linked to corresponding outputs; said physical data captured by sensors linked to corresponding inputs, is derived to an output linked to a saving unit.

2. The apparatus according to claim 1 wherein the controllers are distributed in different points of the exercise equipment and modify the intensity, temperature and humidity of the air flow.

3. The apparatus according to claim 1 the changes in the program entered by the keyboard or by the reading and storage unit do not affect the resident program.

4. The apparatus according to claim 1 wherein the intensity of the air flow is regulated directly by the intensity of use of the exercise equipment.

5. The apparatus according to claim 1 wherein the intensity and continuity of the air flow are modified by applying an algorithm.

6. The apparatus of claim 1, wherein the storage unit is a printer.

* * * * *